United States Patent [19]

Salminen

[11] 4,081,913

[45] Apr. 4, 1978

[54] PULP AND PAPER DRYING APPARATUS AND METHOD

[76] Inventor: Reijo K. Salminen, 1842 Academy Rd., Bellingham, Wash. 98225

[21] Appl. No.: 708,724

[22] Filed: Jul. 26, 1976

[51] Int. Cl.[2] ..... F28F 13/18

[52] U.S. Cl. ..... 34/41; 34/119; 34/124; 165/90; 165/133

[58] Field of Search ..... 34/41, 119, 124, 125, 34/39; 165/133, 89, 90

[56] References Cited

U.S. PATENT DOCUMENTS

| | | | |
|---|---|---|---|
| 3,242,583 | 3/1966 | Calkins | 34/125 |
| 3,466,189 | 9/1969 | Erb | 165/133 |
| 3,633,662 | 1/1972 | Voll | 165/89 |
| 3,943,638 | 3/1976 | Robson | 34/119 |

OTHER PUBLICATIONS

"Engineering", Aug. 17, 1951, pp. 221–222, Heat Transfer During Condensation of Steam by H. Hampson.

*Primary Examiner*—John J. Camby
*Assistant Examiner*—Larry I. Schwartz
*Attorney, Agent, or Firm*—Robert B. Hughes

[57] ABSTRACT

A wood pulp and paper drying machine comprising a plurality of drying drums around which a sheet of pulp or paper material travels in a circuitous path in heat exchange relationship with the drums. Pressurized steam is directed into the interior of each of the drums, with a syphon removing condensate from the interior of each drum. To reduce the effect of the water condensate in the drum inhibiting heat transfer through the cylindrical wall of the drum to the pulp or paper material, the interior surface of each drum is made as a polished metal surface (such as stainless steel) having a roughness index no greater than about 125 and desirably in the order of 4 – 32 on General Electric Surface Roughness Scale Cat. No. 342 × 60.

10 Claims, 8 Drawing Figures

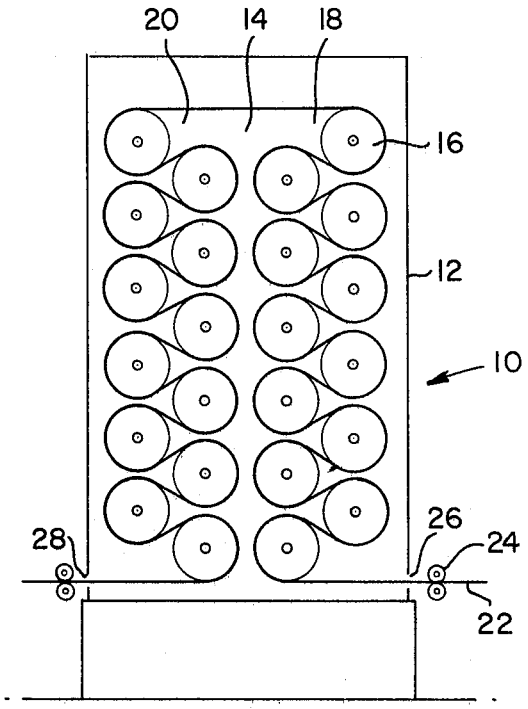
FIG. 1
FIG. 2
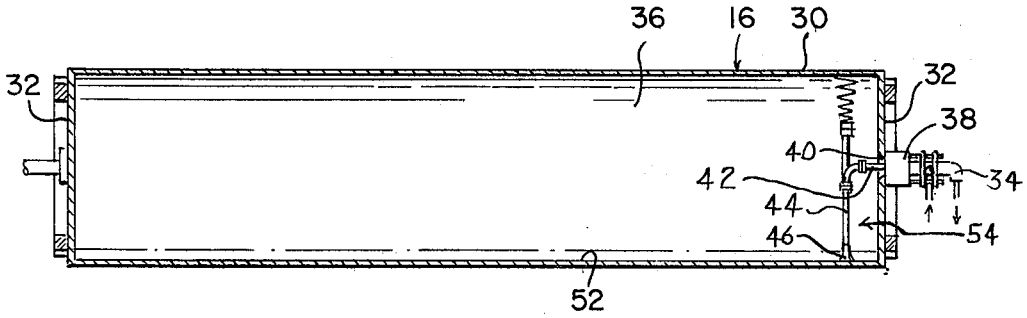
FIG. 3
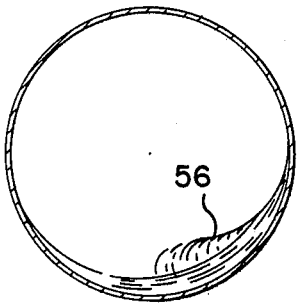
FIG. 4
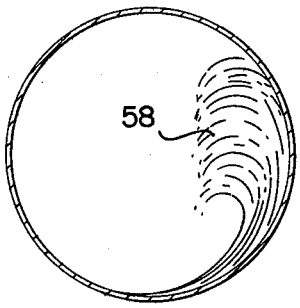
FIG. 5
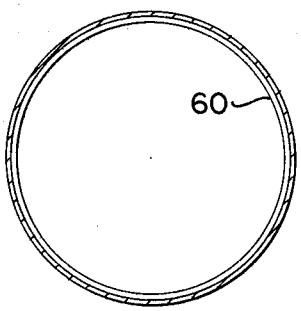

PULP AND PAPER DRYING APPARATUS AND METHOD

BACKGROUND OF THE INVENTION

1. Field of the Invention

The present invention relates to an apparatus and method for drying a sheet of material, such as wood pulp or paper, where the sheet is passed in heat exchange contact around a plurality of drying drums.

2. Description of the Prior Art

In the processing of wood pulp, after the pulp is chemically and mechanically treated by digesting, washing, screening and bleaching, the pulp slurry is usually made into the form of a continuous sheet, and subjected to one or more preliminary dewatering steps (e.g. by dewatering with gravity and directing the wood pulp through squeeze rollers, etc.). However, since the sheet of pulp or paper even after such dewatering quite commonly has a relatively high water content (in the order of 55% water by total weight), it is quite often desirable to subject the wood pulp or paper to further drying to bring the moisture content of the sheet to a lower level (e.g. 10% moisture by total weight).

A common method of accomplishing this final drying step is to run lengths of continuous pulp or paper sheet over a series of steam heated drying drums. The temperature of the pressurized steam in the drums can be as high as approximately 350° F., and the heat passes from this steam through the cylindrical shell of each drum to be transferred to the pulp or paper sheet, to bring the temperature of the sheet to a sufficiently high level to cause rapid evaporation of the moisture in the sheet.

Pulp and paper machines of this general type have existed in the prior art for many years, and these have usually been rather massive installations, comprising a plurality of large cast iron drums. Even a medium sized installation, designed to dry 500 tons per day of wood pulp, has as many as approximately 50 drums, and each drum in itself is approximately 250 inches long and sixty inches in diameter, with the cylindrical shell of the drum generally being about one inch thick.

With the heat energy to cause evaporation of the moisture in the sheet being supplied by the steam which is injected into the drum, the effectiveness of the drying apparatus is in turn dependent upon the ability of the heat from the steam within the drums to be passed through the cylindrical wall of each drum to the sheet.

Since cast iron is a relatively good conductor of heat (capable of transmitting 27 BTU'S per square foot per hour per degree Fahreheit temperature differential per foot of thickness) and since water is a relatively poor conductor of heat (i.e. 0.42 BTU'S/ sq. ft., hr., °F./ ft., so as to have about one sixty-fifths of the heat conducting capacity of cast iron) it has long been recognized that one of the major obstacles to optimum heat transfer through the cylindrical shell of the drum is the water which condenses from the steam in the drum.

Accordingly, considerable effort has been directed toward improved means for removing the water condensate from the interior of the drying drum. Such condensate removal means are generally referred to as "syphons", and these are generally classified into stationary syphons and rotary syphons. As its name implies, the stationary syphon keeps the same orientation within the drum as the drum rotates around the syphon. The intake end or mouth of the syphon is placed quite close to the interior surface of the drum and moderately off the low center point of the interior of the drum in the direction of rotation of the drum, since the water condensate which tends to form as a "puddle" in the lower part of the drum is shifted from the low point in the direction of rotation of the drum. One of the problems with the stationary syphon is that of placing its intake opening sufficiently close to the interior surface of the drum for optimum water removal.

The rotary syphon alleviates to some degree the problem of placing the inlet of the syphon quite close to the interior surface of the drum, since it remains in the same location relative to the drum. However, since with the rotary syphon the inlet of the syphon necessarily rotates with the drum, it passes through the "puddle" of the water condensate only once for every revolution of the drum. Then even with the rotary syphon, there are practical limitations as to how close the inlet can be placed to the interior surface, since the inlet is subject to clogging or other malfunction if the spacing of the inlet opening to the interior wall surface is too close.

There are varying views as to the relative effectiveness of the rotary and stationary syphons. One study indicates the superiority of a rotary syphon over several types of stationary syphons investigated. Specifically, certain test results are cited in a paper entitled "A Comparison of Rotary and Stationary Syphon Performance in Paper Dryers", by D. L. Calkins, the Johnson Corporation, Three Rivers, Michigan, published in 1973. In that paper, the performance of one rotary syphon was compared with that of three stationary syphons having different inlet configurations. The tests were conducted using a conventional cast iron drying drum, having a diameter of 60 inches and an axial length of 250 inches. By measuring the residual condensate in the drum after operation, it was concluded that the rotary syphon design studied was superior to the several stationary syphons used under the same operating conditions in terms of maintaining the total quantity of water condensate in the drum to a practical minimum. Also, the surface temperature of the drum when the rotary syphon was used was somewhat higher than when the three stationary syphons were used. From those tests, it could reasonably be concluded that with the syphon which more effectively removes condensate from the drum interior in terms of total volume of condensate in the drum at any one time, better heat transfer through the cylindrical wall of the drum can be obtained.

Various devices for the removal of condensate from a drum dryer are shown in a number of U.S. patents. For example, U.S. Pat. No. 1,640,019 discloses a plurality of elongate trough members secured to the inner surface of the drum. Each trough is made of sheet metal which is bent into a helical configuration so that the trough opening is directed in the direction of rotation of the drum. U.S. Pat. No. 977,376, Dodge, and U.S. Pat. No. 1,483,343, Gladin, show other arrangements of this same general concept.

U.S. Pat. No. 2,791,038, Armstrong, shows a scoop member to collect water which then passes through a slot. There is a groove-like sump formed axially in the drum inner surface to collect water.

U.S. Pat. No. 2,420,824, Hornbostel et al., shows a collecting trough which is spaced slightly from the interior surface of the drum. The alleged purpose of this configuration is to permit uniform heating along the surface of the drum.

U.S. Pat. No. 3,513,565, Jacobson, shows a device to remove the moisture from the drum where there are a plurality of small tubes which extend radially from a manifold. These tubes are spaced along substantially the entire axial length of the drum, and there are suction tubes to draw the collected water condensate into the center shaft or axle of the drum. The intention of this arrangement is also to provide a more uniform temperature at the drying surface of the drum.

A different approach to the problem of obtaining improved heat transfer through the wall of the drum is disclosed in U.S. Pat. No. 3,426,839, Overton. The steam which is injected into the drum is discharged through jets closely adjacent the inner surface of the cylinder wall to mechanically scour by means of the jets of steam the inner surface of the cylinder wall to break up and remove condensate film. However, the patent states that this requires the use of more steam than can be completely condensed in the cylinder for purposes of providing adequate heat for the drying of the material on the exterior of the drum. Further, since the steam is discharged as jets under pressure, it can be presumed that it is necessary to deliver the steam to the jet nozzles at a pressure higher than that which exists in the interior of the drum.

While many of the improvements in the prior art have improved the heat transfer capability or other characteristics of the prior art drums, there is a continuing need for improvement to enhance the operating effectiveness of such drying equipment. Thus, it is an object of the present invention to provide a method and apparatus for drying material such as a sheet of wood pulp or paper, and specifically to enhance the effectiveness of heat transfer through the walls of a steam heated drum drying apparatus.

SUMMARY OF THE INVENTION

While the main emphasis in the prior art appears to be directed toward effective removal of condensate from the interior of the drum so that the total amount of condensate at any one time is as low as possible, the present invention is predicated upon the realization that consideration must also be given to the operating condition throughout the entire surface of the cylindrical wall of the drum. The above-mentioned Overton Patent, U.S. Pat. No. 3,426,839, does provide an approach to this facet of the problem (i.e. by scouring the interior surface of the drum with steam). However, the method in the Overton patent requires a greater quantity of steam than would normally be used in supplying heat energy to the interior of the drum, and the steam must be provided at a higher pressure than would normally be used.

The present invention is based upon the discovery that by making the interior surface of the cylindrical wall relatively smooth (i.e. of a relatively low roughness index), it is possible to enhance heat transfer through the cylindrical wall of the drum to a remarkable degree. On the basis of data derived from the operation of an apparatus constructed in accordance with the present invention, it is indicated that a drying drum of the present invention is able to impart heat energy to the sheet of pulp material 100% more effectively than the drying drum which is quite commonly used in the prior art.

To demonstrate the operating features of the present invention, a test drum was constructed of stainless steel, with a cylindrical wall thickness of one-fourth inch. The diameter of the test drum was 30 inches, and its axial length was 130 inches. The interior surface of the cylindrical wall had a roughness index of 8, based on the standard General Electric Surface Roughness Scale. When the drum was pressurized with steam at 350° F. at a pressure of 120 pounds per square inch, with the drum being rotated at 32 revolutions per minute, a sheet of wetted felt (the heat transfer characteristics of which closely simulate those of a sheet of pulp or paper) was positioned around the drum in the same manner that such a sheet would be positioned in a full scale drying apparatus with a plurality of such drums. The rate of heat transfer to the sheet was 86.5 BTU's per square foot of drum surface per degree Fahrenheit per hour.

With the type of prior art drum commonly used, which is made of cast iron with the roughness index of the interior surface being approximately 500 to 1,000, on the General Electric Surface Roughness Scale, the thickness of the cylindrical shell being one inch, and the diameter of the drum being 60 inches, the heat transfer value is about 30 BTU's/sq. ft. hr. ° F. for pulp and 35 to 45 BTU's/sq. ft. hr. ° F. for sack paper and liner board. Thus the drum of the present invention was able to transmit through each square foot of drying surface approximately 100% more heat than the prior art drum.

To explain the phenomenon of the present invention the following can be proposed with some justification. It can be surmised that several factors work together to enhance heat transfer by use of the relatively smooth interior wall. First, it is reasonable to assume that the smoother surface would offer less resistance to liquid flow across the surface toward the syphon which removes the water and that the thickness of the film condensate would be less.

To proceed to an additional consideration, it can also be presumed that with the rougher surface, the depressions or cavities at the surface have a substantially greater volume than the cavities which would exist in a relatively smooth surface. The water which collects in such cavities would be less susceptible to movement (i.e. convection currents or eddy currents caused by flow of a thin layer of water over the interior surface of the drum). Thus, the water which collects in such surface cavities would be less disturbed and offer substantially greater impedance to heat transfer therethrough than water which exists as a continuous film or layer, so as to be more susceptible to movement and thus provide greater heat transfer. Since the rougher surface has the substantially greater volume of such water captured in cavities, it can be theorized that there would be a consequent increase in heat transfer when there is a smoother surface.

It is also believed that other related phenomena contribute to the effects of the present invention in reducing resistance to heat transfer. The effect of surface tension in water creates a tendency for water that condenses on a surface to become droplets which draw the water together to provide more exposed surface area on the drum interior and thus enhance heat transfer.

However, regardless of the validity of the various considerations discussed above, it has been found that by use of the drying drum of the present invention, the heat transfer capability of the drum is increased to a significant extent, which in turn increases the operating effectiveness of such drum proportionately.

In the preferred form of the present invention, there is a plurality of drying drums or rolls arranged to define a path of travel for the sheet to be dried, with the sheet travelling a circuitous path around a substantial portion of the circumference of the drums so as to be in heatexchange relationship therewith. Pressurized steam is directed into the interior of each drum, and steam condensate (i.e., water) is removed from the interior of each drum by suitable means, such as a syphon which is or may be of conventional design.

As the sheet is directed along the circuitous path around drying drums, the steam in the drums condenses on the interior surfaces of the drums. By making the interior cylindrical surface of each of the drums with a relatively smooth finish, heat transfer through such cylindrical surfaces is substantially enhanced. Desirably, the interior surfaces of each of the drums should be such that it has a roughness index no greater than about 125, as measured on the General Electric Surface Roughness Scale, Cat. No. 324 × 60, and desirably of a roughness index no greater than 32. Even better results can be obtained by making the interior surfaces very smooth (having a roughness index in the order of 16 to 8 and even as low as 4).

In a preferred embodiment of the present invention, the drying drums are made of stainless steel, with the interior surface of each drum having a roughness index as low as 8 - 16, as measured on the aforementioned General Electric Surface Roughness Scale. In this particular embodiment, the diameter of the drums is 30 inches, and the thickness of this cylindrical shell or side wall is approximately one-fourth inch.

BRIEF DESCRIPTION OF THE DRAWINGS

FIG. 1 is a semi-schematic side elevational view of a drying apparatus incorporating the present invention;

FIG. 2 is a longitudinal sectional view through one of the drums of the apparatus in FIG. 1, said view being taken along the line 2—2 of FIG. 1;

FIGS. 3, 4 and 5 are sectional views taken transverse to the longitudinal axis of a drying drum, and showing three different operating conditions of such drum;

DESCRIPTION OF THE PREFERRED EMBODIMENT

Figure 6:
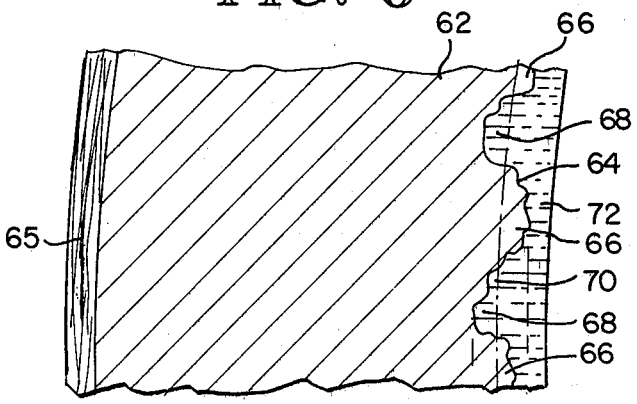
FIG. 6 is a sectional view, drawn to an enlarged scale, of a portion of a cylindrical wall of a typical prior art drying drum made of cast iron.

With reference to FIG. 1, there is shown somewhat schematically a drying apparatus 10 comprising a housing structure 12 which defines a large drying chamber 14. Within the drying chamber 14 there are a plurality of drying drums 16, which in the present configuration are arranged in two vertically aligned sets 18 and 20. As is commonly done in the prior art, the drums 16 of each set 18 or 20 are arranged in two rows with the individual drums of two adjacent rows being staggered in a side-by-side relationship.

Since the present invention is particularly adapted for drying a sheet of material, such as wood pulp or paper, the present invention will be described with reference to a sheet of such material. Thus, as shown in FIG. 1, there is sheet 22 of pulp or paper which is shown passing through a set of squeeze drums 24 and through an entrance opening 26 in the housing 12. The drums 16 collectively define a circuitous path of travel beginning at the entry location 26 and proceeding through the chamber 14 in a serpentine path around a major portion of the circumference of the many drums 16 and exiting at an exit opening 28 positioned oppositely from the entrance 26. Thus the sheet 22 is in heat-exchange relationship with a substantial portion of the outer cylindrical surface of each of the drums 16 as it travels its path through the drying apparatus 10. It is to be understood that the drying apparatus 10 is provided with adequate air circulating means within the housing 12 to carry away the moisture evaporated from the sheet 22. For convenience of illustration, such air circulating means are not shown in the accompanying drawing.

With reference to FIG. 2, it can be seen that each drum 16 comprises a cylindrical side wall or shell 30 and two end walls 32. At the location of one end wall 32, there is a combined steam inlet and condensate exhaust conduit 34 which leads into the interior 36 of the drum 18 through a rotary fitting shown schematically at 38 at the axial center line of the roll 16. This conduit 34 comprises outer and inner pipes, which define an outer annular steam inlet passage and an innter condensate removal passage. Steam enters the interior 36 of the drum 16 through an inlet opening 40. The condensate removal pipe section 42 has a right angle section 44, with the radially outer end of this pipe section 44 terminating in an inlet member 46 positioned closely adjacent to the inner surface 52 of the drum 16. This pipe 42–44 and intake member 50 collectively constitute a "syphon", generally designated 54. This syphon 54 is or may be of conventional design, and in the particular embodiment shown herein, this syphon is of the rotary type with a single intake member 46. (For convenience of illustration, the syphon 54 is shown as having only one inlet 46 at one end of the drum 16. It should be understood that such inlet 46 could be located at the mid-length of the drum 16 or that a plurality of such inlets could be provided along the length of the drum 16.)

To review briefly the functioning of the apparatus described thus far, the sheet 22 is a continuous sheet which is directed through the inlet opening 26 into the apparatus 10 to pass in a circuitous path in a heat-exchange relationship with the multiplicity of drums 16, and to exit at the opening 28. Each of the drums 16 is rotatably mounted, and suitable drive means are provided to rotate the drums 16 and cause the sheet 22 to proceed on its path through the apparatus 10. Pressurized steam is injected into each drums 16 through the respective steam inlet openings 40. The steam in the interior 36 of the drum 16 condenses on the interior cylindrical wall surface 52 to transmit heat into the wall 30 which in turn imparts heat to the sheet 22 to cause moisture to be evaporated therefrom. As steam condensate continues to collect as water in the drum interior 36, the syphon 54 functions to remove this water by drawing water into the syphon inlet 46.

As indicated previously herein, the nature of the interior surface 52 of the cylindrical wall 30 of the drum 16 is particularly significant in the present invention. The surface 52 is relatively smooth in comparison with drying drums that exist in the prior art, and desirably should have a roughness index (as measured by the General Electric Surface Roughness Scale Cat. No. 342 × 60) of no greater than 125, and desirably no greater than approximately 32. Increasingly better results can be obtained with even smoother surfaces, with the practical lower limit being the smoothness obtainable within the limits of the cost consideration balanced against the benefits derived. Current estimates indicate that where the surface 52 is of a smoothness that its roughness index is as low as 4 on the General Electric scale, this degree of a smoothness would likely be within the practical lower limit for many drying operations.

It is believed that a clearer understanding of the present invention will be obtained by giving preliminary consideration to the manner in which drying drums in general function with respect to the water condensate contained therein, this being done with reference to FIGS. 3, 4 and 5. For purposes of analysis, the "behavior" of the water which is the steam condensate within the drum can be placed into three categories of oeprating conditions: (a) the "puddling" condition, (b) the "cascading" condition, (c) the "rimming" condition.

The puddling condition is illustrated in the FIG. 3. As water collects on the interior surface 52, since the drum 16 has its longitudinal axis of rotation horizontally disposed, gravity tends to pull the collected water down toward the lowest part of the interior of the drum 16 to form a "puddle" indicated at 56 FIG. 3. With the drum 16 rotating (counterclockwise as illustrated in FIG. 3), the frictional force of the interior surface 52 of the drum 16 tends to carry this puddle 56 upwardly and to the right, as seen in FIG. 3. In the condition shown in FIG. 3, the force of gravity acting on the puddle 56 is sufficiently large, relative to the frictional force of the surface 52 moving by the puddle 56, that the puddle 56 is shifted moderately from the low center point in the direction of rotation of the drum 16. The puddling condition results when the drum 16 is rotating at a relatively lower speed.

FIG. 4 represents an intermediate condition which is called the "cascading" condition. In this condition, the force resulting from the frictional engagement of the surface 52 with the water condensate is adequate to carry the condensate toward the top part of the drum 16. At this location the force of gravity is sufficient to draw the water away from the interior surface 52, with the water falling or "cascading" back to the bottom of the interior of drum 16. This cascading water is indicated at 58 in FIG. 4.

FIG. 5 illustrates the "rimming" condition, where the water condensate becomes distributed around the entire interior surface 52 of the cylindrical wall or shell 30, this rimming occurring at the relatively higher rotational speeds. This rimming condition is a result of the combination of the frictional force of the surface 52 acting on the water condensate and the centrifugal force imparted to such condensate by virtue of the relatively high rotational speed of the drum 16. In this condition the water condensate becomes distributed as a layer 60 around the entire interior surface 52.

To give consideration to another phase of the action of the water condensate within the drum 16, reference is made again to FIG. 2. As the syphon inlet 46 continues to take in the water condensate, the remaining water condensate tends to flow longitudinally in the drum 16 toward the syphon inlet 46 (i.e. flow parallel to the axis of rotation of the drum 16.). Even when there are two or more syphon inlets 46 at spaced longitudinal locations, there is still this longitudinal flow, but over shorter longitudinal lengths of travel. Thus it can be seen that while the behavior of the water condensate differs with respect to the three conditions shown in FIGS. 3, 4 and 5, there is the common characteristic that in each of these conditions there must be flow longitudinally within the drum 16 for the water condensate to reach the removal location of the syphon inlet 46.

Consideration will now be given to the conditions which exist at the interior surface of prior art drying drums and the drying drum of the present invention. FIG. 6 illustrates a small section, drawn to an enlarged scale, of a portion of the cylindrical wall 62 of a typical prior art drying drum, made of cast iron, and having an interior surface 64 with a roughness index between approximately 500 to 1,000 based on the General Electric scale. A portion of a sheet of pulp or paper 65 is shown against the outer surface of the drum 62.

It is to be understood that the representation in FIG. 6 is given essentially for purposes of explanation, and it is not necessarily drawn to scale or is not necessarily a precise representation of the configuration of the interior surface configuration of a typical prior art cast iron drying drum. However, the representation in FIG. 6 is believed to be sufficient to serve as a basis for a discussion of the prior art drying drum relative to the present invention.

It can be seen that the interior surface 64 of a typical prior art drying drum 62 has a plurality of protrusions 66 separated by recesses 68. As water condenses on the surface 64, it fills the many recesses 68 and tends to build up as a layer beyond the protrusions 66. The water in the recesses 68 is designated 70 while the water existing as a layer above such recesses 68 is designated 72.

Figure 8:
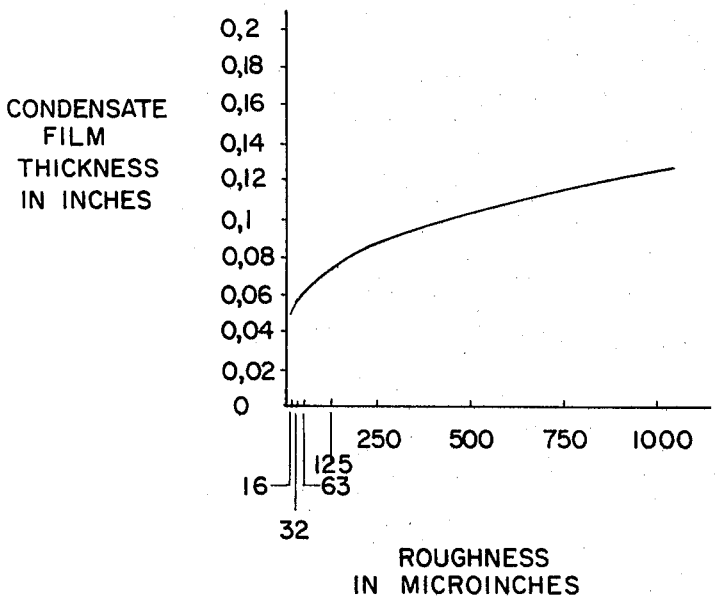
FIG. 8 is a graph showing theoretical values for condensate film thickness on the cylindrical wall of a drying drum, plotted against the roughness of the interior surface of the cylindrical wall of the drying drum.

For purposes of analysis, to determine the frictional effects of the surface 64 on the flow of water thereover, the entire drum 62 can be considered as a section of pipe or conduit of large diameter, with the axial center line of the drum 62 being coincident with the longitudinal axis of the pipe. Then by applying known formulas relating to liquid flow through pipes, the condensate film thickness can be plotted against the roughness value a the interior surface of the drying drum. The values arrived by such calculations are illustrated in FIG. 8, the curve being for a drum having an inside diameter of five feet. It can be seen that as the interior of the drum is made smoother, the condensate film thickness diminishes. On the basis of this analysis, it can be expected that the total thickness of the film condensate on the surface 64 would decrease as the surface 64 is made smoother.

It is believed that another consideration of some significance in the present invention is the action of the water 70 in the cavities 68. It is known that water is a relatively poor conductor of heat (having a conductive capacity 1/65 that of cast iron), but that the conductivity of a body of water is increased substantially with convection currents or the like in the water. It is believed that the water existing in the layer 72 is more subject to flow across the surface 64 than the water 70 in the cavities 68. It is surmised that the portion of water in this layer 72 that is nearer the surface 64 encounters more resistance than the portion of the layer 72 furthest from the surface 64, and that this results in something analogous to eddy currents where the water further from the surface 64 tends to flow back toward the surface 64 and again away therefrom as the water flows over the surface 64. However, the water in the cavity 68 would, it is believed, be less likely to be subjected to such "eddy currents", and thus would have less of a tendency to conduct heat therethrough.

Thus, it is believed that the combination of a water condensate film and the areas of stagnation in the water due to the existence of greater cavity volume on the surface 64 combine to inhibit the transfer of heat therethrough to a significant degree when the surface at the interior of the drying drum on which the film condensate forms is relatively rough.

Figure 7:
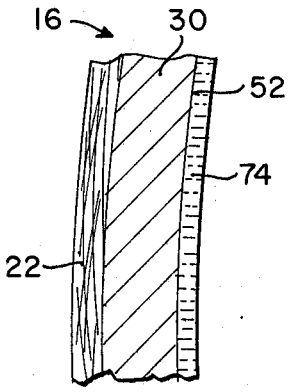
FIG. 7 is a view similar to FIG. 6, but showing a portion of the wall or shell of the drying drum of a preferred form of the present invention.

Reference is now made to FIG. 7 which illustrates a small portion of a drying drum 16 of the present invention, drawn to an enlarged scale. As with the representation of FIG. 6, this is not drawn to a precise scale and is not intended to be any precise representation of the drum. It can be seen that the drum 16 has its interior surface 52 made quite smooth. While there certainly are some quite small cavities on the surface 52, for purposes of analysis these can be considered to be minimal. The overall thickness of the water condensate film 74 is less than that existing in the drum of FIG. 6. Also the volume of water in any surface cavities is substantially less. It is believed that these factors cooperate to greatly enhance heat transfer at the surface 52.

It is to be understood that the above explanation cannot by any means be considered to be exhaustive of all the phenomena relating to heat transfer at the interior surface of the drum. First, the conditions inside a drying drum (high pressures and temperatures sometimes in excess of 300° F.) make it quite difficult to make accurate observations on a minute scale. Second, there are quite likely other phenomena, for example the surface tension of the water and its tendency to form into droplets and to adhere to different surfaces in certain ways, which may also have an effect of some significance. At any rate, regardless of the completeness or correctness of the above considerations, it has been found that by employing the teachings of the present invention and making the interior surface of the drum relatively smooth in comparison with the prior art drums, a quite significant increase in heat transfer effectiveness can be accomplished.

In an actual drum 16 made according to the present invention, the cylindrical side wall 30 was made of stainless steel one-fourth inch in diameter, with the interior surface 52 having a roughness index of 8 based upon the aforementioned General Electric scale. The diameter of this drum was 30 inches, and its axial length 130 inches. This drum was operated to dry a sheet of felt, with pressurized steam of 120 psi and 350° F. directed into the drum 16. The drum 16 was rotated 32 revolutions per minute. By computing the rate of evaporation of water from the pulp sheet 74 being dried, it was found that the rate of heat transfer to the sheet 74 was 86.5 BTU's per square foot of drum surface per degree Fahrenheit per hour. This was compared with heat transfer values obtained for a typical prior art drum such as that shown in FIG. 6. Then the impedance of heat transfer at the condensate film on the drum of the present invention was compared with the impedance to heat transfer at the condensate film on the typical prior art drying drum of FIG. 6, taking into account such factors as the difference in thickness of the two drums, the conductivity of cast iron as opposed to stainless steel, etc. It was found that the impedance to heat transfer at the interior drum surface was in the present invention approximately one-half that of the typical prior art drying drum.

Since the shell 30 of the drum 16 must be structurally strong and be a good conductor of heat, it will normally be made of a metal, such as cast iron or steel. A common way of obtaining a smooth interior finish to the drum 16 is to mechanically polish the surface by means of a suitable abrasive. However, it is to be understood that within the broader aspects of the present invention, other means could be used, such as electrically polishing the surface or utilizing a suitable material applied as a thin layer to the interior surface.

It is to be understood that various changes can be made in the invention without departing from the essential teachings thereof.

What is claimed is:

1. In a method of drying a sheet of material, such as wood pulp or paper, wherein the method comprises:

a. directing said sheet along a path of travel through one or more rotatably mounted drying drums, with the sheet traveling in a circuitous path around a substantial portion of the circumference of each drum so as to be in heat exchange relationship therewith, and b. directing pressurized steam into the interior of each drum and removing from each drum interior steam condensate that forms therein, an improvement to increase the effectiveness of heat transfer to the sheet being dried, said method comprising:

condensing said steam in each drum on an interior surface thereof, which interior surface is of a smooth finish sufficient to reduce impedence of heat transfer due to water condensate at the interior surface of each drum, the interior surfaces of each drum having a roughness index at least at low as approximately 125 as measured on the General Electric Surface Roughness Index Scale Cat. No. 342 × 60.

2. The method as recited in claim 1, wherein the interior surface of each drum has a roughness index at least as low as approximately 32 as measured on the General Electric Surface Roughness Index Scale Cat. No. 342 × 60.

3. The method as recited in claim 1, wherein the interior surface of each drum has a roughness index between about 4 and 32 as measured on the General Electric Roughness Index Scale Cat. No. 342 × 60.

4. The method as recited in claim 1, wherein the method is accomplished by providing each drum having a stainless steel cylindrical shell with a smooth interior surface.

5. The method as recited in claim 1, wherein the mehod is accomplished by providing each drum as a stainless steel cylindrical shell of a roughness index no greater than about 32, as measured on the General Electric Roughness Index Scale Cat. No. 342 × 60.

6. In an apparatus to dry a sheet of material, such as wood pulp or paper, wherein the machine comprises:

a. a plurality of rotatably mounted drying drums arranged to define a path of travel for the sheet through the apparatus, with the sheet traveling a circuitous path around a substantial portion of the circumference of the drums so as to be in heat exchange relationship therewith, b. each of said drums having a steam inlet through which pressurized steam can be directed into the drum interior, c. each of said drums having a condensate removal means through which steam condensate can be removed from the interior of the drum, and d. each of said drums having a cylindrical heat conducting side wall, said side wall having an exterior heat exchange surface to be in heat exchange contact with said sheet, and an interior heat exchange surface to be in heat exchange relationship with steam in the drum, an improvement to decrease resistance to heat transfer at the interior surface of each drum, said improvement comprising:

each of said drums having an interior heat exchange surface of a smooth finish sufficient to reduce impedance of heat transfer due to water condensate at the interior surfaces of the drums, the interior surface of each of the drums having a roughness index of at least as low as 125, as measured on the General Electric Roughness Index Scale Cat. No. 342 × 60.

7. The apparatus as recited in claim 6, wherein the interior surface of each of the drums has a roughness index at least as low as 32, as measured on the General Electric Roughness Index Scale Cat. No. 342 × 60.

8. The apparatus as recited in claim 6, wherein the interior surface of each of the drums has a roughness index between about 4 and 32, as measured on the General Electric Roughness Index Scale Cat. No. 342 × 60.

9. The apparatus as recited in claim 6, wherein each of said drums has a cylindrical shell made of stainless steel with a smooth interior surface.

10. The apparatus as recited in claim 6, wherein each of said drums has a cylindrical shell made of stainless steel with an interior surface of a roughness index no greater than 32 as measured on the General Electric Roughness Index Scale Cat. No. 342 × 60.

* * * * *